US010321768B2

(12) United States Patent
Harrow

(10) Patent No.: US 10,321,768 B2
(45) **Date of Patent: *Jun. 18, 2019**

(54) FOLDABLE BED FRAME WITH SLOPING STOP

(71) Applicant: Jason Harrow, Los Angeles, CA (US)

(72) Inventor: Jason Harrow, Los Angeles, CA (US)

( * ) Notice: Subject to any disclaimer, the term of this patent is extended or adjusted under 35 U.S.C. 154(b) by 395 days.

This patent is subject to a terminal disclaimer.

(21) Appl. No.: 15/212,438

(22) Filed: Jul. 18, 2016

(65) Prior Publication Data

US 2016/0324327 A1 Nov. 10, 2016

Related U.S. Application Data

(63) Continuation of application No. 14/325,086, filed on Jul. 7, 2014, now Pat. No. 9,414,690.

(60) Provisional application No. 61/908,656, filed on Nov. 25, 2013, provisional application No. 61/931,349, filed on Jan. 24, 2014.

(51) Int. Cl.
*A47C 19/00* (2006.01)
*A47C 19/12* (2006.01)

(52) U.S. Cl.
CPC ..... *A47C 19/12* (2013.01); *A47C 19/005* (2013.01); *A47C 19/122* (2013.01)

(58) Field of Classification Search
CPC ... A47C 19/122; A47C 19/124; A47C 19/126; A47C 19/00; A47C 19/005; A47C 19/12
See application file for complete search history.

(56) References Cited

U.S. PATENT DOCUMENTS

| | | | |
|---|---|---|---|
| 589,482 | A | 9/1897 | Rimmelin |
| 860,938 | A | 7/1907 | Richards |
| 1,323,257 | A | 12/1919 | Dudek |
| 1,348,156 | A | 8/1920 | De Does |
| 1,348,944 | A | 8/1920 | Hartman et al. |

(Continued)

FOREIGN PATENT DOCUMENTS

| | | |
|---|---|---|
| GB | 191421854 | 7/1915 |
| GB | 378221 | 8/1932 |

(Continued)

OTHER PUBLICATIONS

Prosecution history of parent U.S. Appl. No. 14/325,086 (U.S. Pat. No. 9,414,690).

(Continued)

*Primary Examiner* — Nicholas F Polito
*Assistant Examiner* — Myles A Throop
(74) *Attorney, Agent, or Firm* — Joseph G. Swan, P.C.

(57) ABSTRACT

A bed frame has: a left side component that includes an elongated left side rail and an extending segment at each end; and a right side component that includes an elongated right side rail and an extending segment at each end. Each such extending segment is pivotally attached to the corresponding elongated right side rail and is capable of being pivoted from substantially parallel it to substantially perpendicular it. Each of the elongated left side rail and the elongated right side rail includes two main sections that are pivotally attached to a shorter center member. At each end, the extending segments of the left side component and the right side component detachably couple to each other, forming lateral components of a bed frame assembly.

13 Claims, 11 Drawing Sheets

(56) References Cited

U.S. PATENT DOCUMENTS

| | | | | |
|---|---|---|---|---|
| 1,476,279 | A | 12/1923 | Basford | |
| 2,203,193 | A | 6/1940 | Ettinger et al. | |
| 2,541,438 | A | 2/1951 | Rossman | |
| 2,572,642 | A | 10/1951 | Margiloff | |
| 2,590,129 | A | 3/1952 | Sawaya | |
| 2,591,551 | A | 4/1952 | Kaplan | |
| 2,651,787 | A | 9/1953 | Piliero | |
| 2,826,765 | A | 3/1958 | Entwistle | |
| 2,964,760 | A | 12/1960 | Fox | |
| 2,985,894 | A | 5/1961 | Goldberg | |
| 3,100,304 | A | 8/1963 | Brandlin et al. | |
| 3,123,837 | A | 3/1964 | Paine et al. | |
| 3,225,363 | A | 12/1965 | Kirsch | |
| 3,245,091 | A | 4/1966 | Spitz | |
| 3,329,975 | A | 7/1967 | Hooker | |
| 3,491,998 | A | 1/1970 | Goodwin | |
| 3,510,887 | A | 5/1970 | Spitz | |
| 3,555,579 | A | 1/1971 | Harris | |
| 3,813,710 | A | 6/1974 | Janko | |
| 4,070,717 | A | 1/1978 | Kitchen et al. | |
| 4,103,374 | A | 8/1978 | Knoke | |
| 4,224,704 | A | 9/1980 | Nowell | |
| 4,225,265 | A * | 9/1980 | Hooker | A47C 19/005 248/222.41 |
| 4,234,979 | A | 11/1980 | Bergerud | |
| 4,329,746 | A | 5/1982 | Bergerud | |
| 4,399,571 | A | 8/1983 | Joyce | |
| 4,523,342 | A | 6/1985 | Poovey | |
| 4,536,904 | A | 8/1985 | Whitehead | |
| 4,635,305 | A | 1/1987 | Wyss | |
| 5,161,268 | A | 11/1992 | Harrow | |
| 5,913,770 | A | 6/1999 | Tseng | |
| 5,970,537 | A | 10/1999 | Hanes et al. | |
| 6,035,464 | A | 3/2000 | Williams | |
| 6,065,163 | A | 5/2000 | Hung | |
| 6,076,210 | A | 6/2000 | Wu | |
| 6,209,155 | B1 | 4/2001 | Epstein et al. | |
| 6,338,172 | B1 | 1/2002 | Taylor et al. | |
| 6,553,586 | B1 | 4/2003 | Lin | |
| 6,564,402 | B1 | 5/2003 | Lin | |
| 6,634,039 | B1 | 10/2003 | Cheng | |
| 6,941,596 | B2 | 9/2005 | Schuman et al. | |
| 7,134,154 | B2 | 11/2006 | Cloer et al. | |
| 7,398,566 | B1 | 7/2008 | Merritt | |
| 7,600,278 | B2 | 10/2009 | Oh | |
| 8,006,328 | B2 | 8/2011 | Polevoy et al. | |
| 8,056,159 | B2 | 11/2011 | Lee et al. | |
| 8,091,160 | B2 | 1/2012 | Jin | |
| 8,621,685 | B2 | 1/2014 | Jin | |
| 8,832,876 | B1 | 9/2014 | Oh | |
| 8,978,176 | B1 * | 3/2015 | Oh | A47C 19/005 5/200.1 |
| 2008/0168602 | A1 | 7/2008 | DiForio | |
| 2008/0222802 | A1 | 9/2008 | Harrow | |
| 2009/0100597 | A1 | 4/2009 | Oh | |
| 2009/0106896 | A1 | 4/2009 | Olah | |
| 2009/0133191 | A1 * | 5/2009 | Harrow | A47C 19/005 5/202 |
| 2009/0300840 | A1 | 12/2009 | Polevoy et al. | |
| 2010/0005587 | A1 | 1/2010 | Choi | |
| 2010/0235989 | A1 | 9/2010 | Jin | |
| 2010/0275372 | A1 | 11/2010 | Oh | |
| 2010/0299831 | A1 | 12/2010 | Lee | |
| 2011/0099712 | A1 | 5/2011 | Jin | |
| 2011/0308012 | A1 | 12/2011 | Jin | |
| 2012/0222216 | A1 | 9/2012 | Jin | |
| 2012/0246826 | A1 * | 10/2012 | Jin | A47C 19/04 5/400 |
| 2012/0304380 | A1 | 12/2012 | Jin | |
| 2013/0312185 | A1 | 11/2013 | Suh | |

FOREIGN PATENT DOCUMENTS

| | | | | |
|---|---|---|---|---|
| GB | 378221 A * | 8/1932 | | A47C 19/122 |
| GB | 687394 | 2/1953 | | |
| GB | 765116 | 1/1957 | | |
| GB | 765116 A * | 1/1957 | | A47C 19/122 |
| GB | 1188915 | 4/1970 | | |
| GB | 2498040 | 7/2013 | | |
| JP | 2002262963 | 9/2002 | | |
| WO | W02011085673 | 7/2011 | | |

OTHER PUBLICATIONS

Annotated photographs of bed frame Model #1870BL, sold by Hollywood Bed & Spring Mfg. Co., Inc. (DBA Hollywood Bedframe), the current assignee, prior to Nov. 2012.

* cited by examiner

FOLDABLE BED FRAME WITH SLOPING STOP

This application claims the benefit of U.S. Provisional Patent Application Ser. No. 61/908,656 (filed on Nov. 25, 2013) and 61/931,349 (filed on Jan. 24, 2014), which are incorporated by reference herein as though set forth herein in full.

FIELD OF THE INVENTION

The present invention pertains, among other things, to bed frames, e.g., for supporting a mattress and/or box spring, as well as to components thereof and systems, methods and techniques for using any of the foregoing items.

BACKGROUND

Bed frames are the structures used to support a bed's box spring and/or mattress, elevating them off the floor, e.g., so that the bed is at a more comfortable height, making it is easier to get into and out of the bed. A variety of different conventional bed frames exist. Some are wooden platforms. Probably the most common and least expensive type, however, is a steel frame that typically includes, a peripheral structure, often one or more cross beams to provide additional support, and multiple legs. Unfortunately, the present inventor has discovered that most of such conventional steel bed frames, while adequate for the foregoing basic purpose, often are cumbersome to deal with, e.g., in terms of packaging, shipping, and then subsequent assembly and disassembly when it is desired to move the bed frame to a different location.

SUMMARY OF THE INVENTION

The present invention addresses these issues and primarily concerns: a foldable bed frame; various components of such a frame; and methods for folding, unfolding and using such a frame. Generally speaking, a bed frame according to the present invention typically has two main configurations: one in which the frame is folded up for storage, shipment or the like; and another in which the frame is completely unfolded and ready for use, e.g., to support a box spring and mattress. The completely unfolded configuration sometimes is referred to herein as the operational configuration.

Thus, one embodiment of the invention is directed to a bed frame that has: a left side component (e.g., 75) that includes an elongated left side rail (e.g., 14) and an extending segment (e.g., 76 or 77) at each end, each such extending segment pivotally attached to the elongated left side rail and capable of being pivoted from substantially parallel the left side rail to substantially perpendicular to the left side rail; and a right side component (e.g., 85) that includes an elongated right side rail (e.g., 15) and an extending segment (e.g., 86 or 87) at each end, each such extending segment pivotally attached to the elongated right side rail and capable of being pivoted from substantially parallel the right side rail to substantially perpendicular the right side rail. Each of the elongated left side rail and the elongated right side rail includes two main sections (e.g., 21 and 22 or 41 and 42) that are pivotally attached to a shorter center member (e.g., 25 or 45). At each end, the extending segments of the left side component and the right side component detachably couple to each other, forming lateral components of a bed frame assembly.

Another embodiment is directed to a bed frame that includes a center component (e.g., 65), a left side component (e.g., 75) and a right side component (e.g., 85). The center component includes an elongated center support (e.g., 12) and a pair of opposite first extending segments (e.g., 66 or 67) at each end, each of the first extending segments pivotally attached to the elongated center support and capable of being pivoted from substantially parallel said center support to substantially perpendicular said center support. The left side component includes an elongated left side rail (e.g., 14) and a second extending segment (e.g., 76 or 77) at each end, each such second extending segment pivotally attached to the elongated left side rail and capable of being pivoted from substantially parallel said left side rail to substantially perpendicular said left side rail. The right side component that includes an elongated right side rail (e.g., 15) and a third extending segment (e.g., 86 or 87) at each end, each said third extending segment pivotally attached to the elongated right side rail and capable of being pivoted from substantially parallel said right side rail to substantially perpendicular said right side rail. Each of the elongated center support, the elongated left side rail and the elongated right side rail includes two main sections (e.g., 21 and 22 or 41 and 42) that are pivotally attached to a shorter center member (e.g., 25 or 45). Each pair of the first extending segments detachably attaches to one of the second extending segments and one of the third extending segments to provide a bed frame assembly.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

DESCRIPTION OF THE PREFERRED EMBODIMENT(S)

Figure 1:
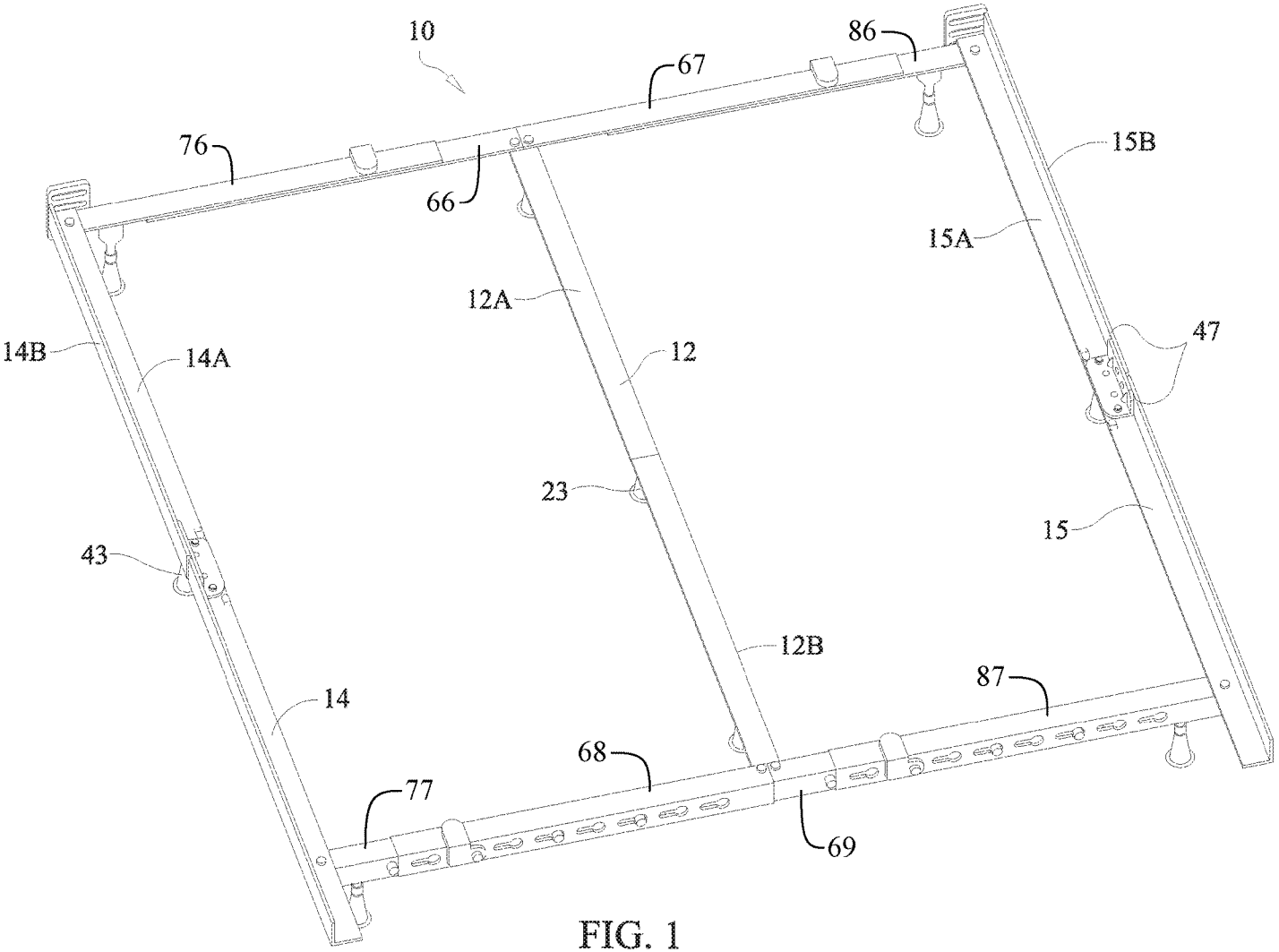
FIG. 1 is a top perspective view of a completely unfolded and assembled bed frame (i.e., ready for use, or in its operational configuration), according to a representative embodiment of the present invention.

The bed frame 10 shown in FIG. 1 can function as an ordinary bed frame. That is, it can support a box spring and/or mattress placed on top of it. The depicted bed frame 10 includes a center support 12 and two side rails 14 and 15, with the bed frame 10 preferably sized to accommodate a box spring and/or mattress of a standard size (e.g., twin, full, double, queen, king or California king). However, unlike conventional bed frames, the present frame 10 can be folded up for easier storage, shipping or the like. For example, the central portion of each of center support 12 and side rails 14 and 15 includes two seams (and corresponding pivot points), and each preferably can be bent at a 90° angle so that the entire frame 10 essentially can be folded in half along its length. In fact, in embodiments where a gap is provided between such seams, the maximum folded-up dimension of the present bed frame 10 is less than half the full length of the frame when in operational use. Still further, as discussed in greater detail below, other portions of the center support 12 and side rails 14 and 15 also can include foldable joints (e.g., of a conventional nature) and detachment points so that the entire bed frame 10 can be just partially disassembled and then the resulting beams easily folded, so that the entire bed frame 10 fits in a small box that can be hand carried and/or readily shipped and then quickly and easily removed and assembled.

Figure 2:
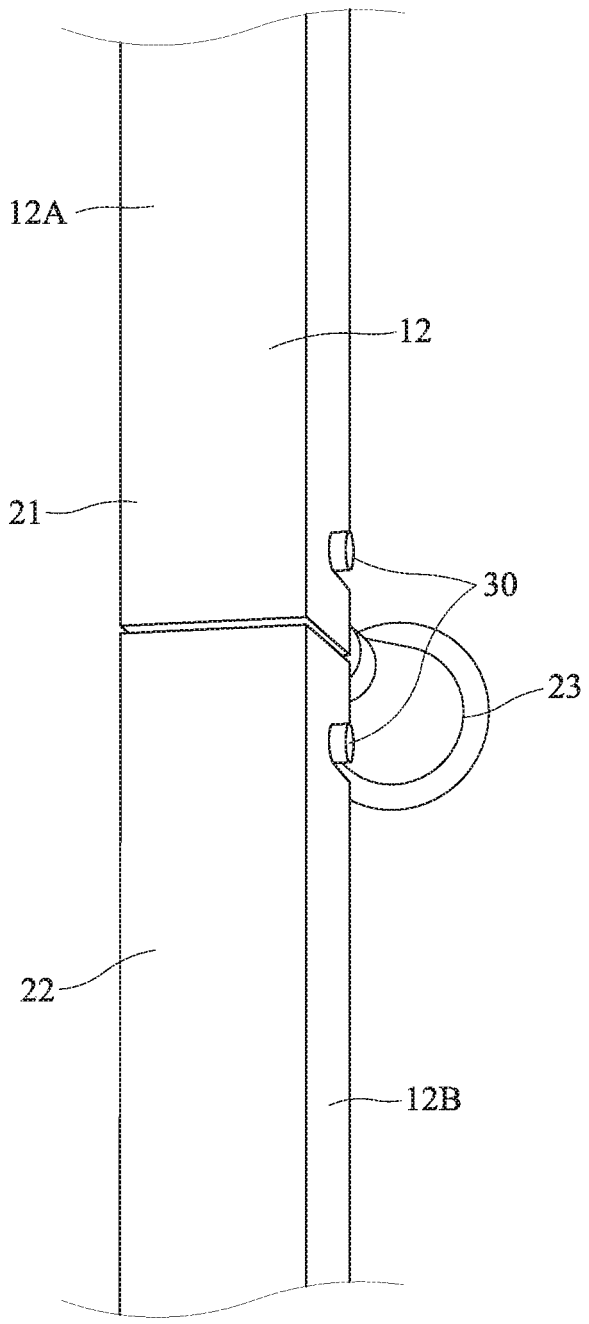
FIG. 2 is a top perspective view of the central portion of the bed frame's center support, in its operational configuration.
Figure 3:
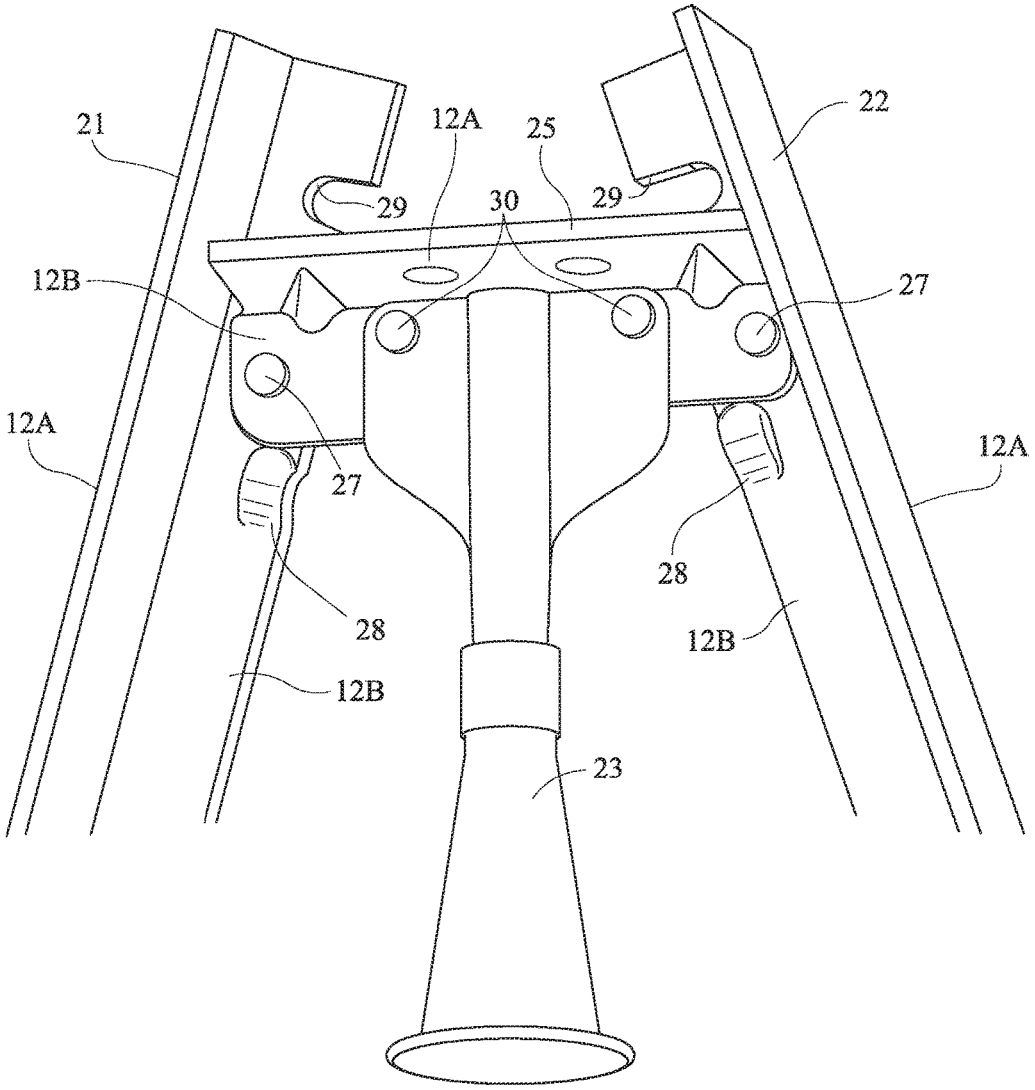
FIG. 3 is a perspective first side view of the central portion of the center support, in a partially folded configuration.

FIG. 2 shows a close-up view of the central portion of center support 12 while in the operational orientation. As shown, center support 12 includes two main sections 21 and 22. In addition, as shown in FIG. 3, sections 21 and 22 are joined together with the use of a shorter member 25 (preferably, approximately 3-8 inches in length and, in the currently preferred embodiment, approximately 3¾ inches long) that is pivotally attached to each of sections 21 and 22 using a corresponding rivet 27. In alternate embodiments, pins or other pivoting elements may be used in place of rivets 27.

In the present embodiment, each of elements 21, 22 and 25 has an L-shaped cross-section, consisting of two elongated panels 12A and 12B, integrally formed together and at least approximately perpendicular to each other (e.g., forming an angle of 80-100° or, more preferably, 85-95°). In operational use, for each of elements 21 and 22, one of such panels 12A preferably is substantially horizontal and functions as a flat bottom surface for the bed frame, and the other panel 12B preferably is a substantially vertical side panel extending downwardly, while the panels 12A and 12B for element 25 parallel and overlap the corresponding panels for element 21 and 22, with element 25 disposed inside of elements 21 and 22. As shown most clearly in FIG. 3, rivets 27 join sections 21 and 22 to member 25 along such elements' downwardly extending side panels 12B.

In the current embodiment, portions 28 of panels 12B have been punched (or dented) so that they bulge inwardly and essentially act as stops, maintaining sections 21 and 22 at approximately right angles with respect to member 25 when the bed frame 10 is in the folded-up configuration. Still further, punches (or other protrusions) 28 can provide for easier folding, by functioning as a kind of guide, allowing for additional leverage and/or stabilizing the various segments relative to each other while the component is being folded up. In alternate embodiments, punches 28 can be replaced with any other protruding elements, such as any other protrusions formed into the material that is used to fabricate sections 21 and 22 (typically steel), or separate elements such as rivets. When punches 28 are used, the protrusions typically are formed with smoothly sloping sides so that the edges of member 25 gradually engage with such protrusions, essentially locking the components together. More preferably, each such protrusion is formed by essentially hammering the opposite side of the panel 12B at the same time (i.e., in the same step) that the holes and/or notches are cut or otherwise formed into such sections 21 and 22. As result, both the cost of a rivet (or other separate component) and the additional manufacturing step of inserting it can be eliminated.

In addition, attached to the downwardly extending side panel 12B of member 25 in the present embodiment (e.g., using a pair of rivets 30) is a leg 23 for supporting the frame 10 when in operational use. In the current embodiment, each leg of the bed frame (including leg 23) includes an upper post portion (e.g., post portion 23A) and a lower glide portion (e.g., glide portion 23B), with the glide portion 23B capable of being slid onto the post portion 23A (e.g., for operational use) and slid off of it (e.g., for storage and/or shipment). However, in alternate embodiments any or all of the legs of a bed frame according to the present invention can be provided with a caster, other type of roller, or other type of bottom portion, and/or can be provided as a single unitary piece. When the bed frame 10 is unfolded into the operational configuration, notches 29 engage with the sides of rivets 30 depicted in FIG. 4, thereby securing center support 12 so that sections 21 and 22 together provide a flat surface and remain aligned with each other.

Similar to center support 12, each of side rails 14 and 15 includes two main sections 41 and 42 (typically made of steel) joined together through the use of a central member 45. All of such elements preferably also have L-shaped cross-sections. However, elements 41, 42 and 45 preferably are oriented so as to form the bottom 14A and side 14B surfaces of the bed frame when it is in operational use (as opposed to center support 12, which is only intended to provide a single flat bottom surface of the frame). FIGS. 5-8 depict the central portion of the left side rail 14, with right side rail 15 preferably having the same (but mirror-image) structure.

In the present embodiment, member 45 is pivotally attached to sections 41 and 42, using rivets 47 in the components' sidewall panels 14B. However, in alternate embodiments pins or any other pivoting elements may be used in place of rivets 47. In addition, in the present embodiment a support leg 43, which supports the bed frame when in operational use, is attached to the bottom panel 14A of one of the sections (section 41 in the present embodiment), using a pair of rivets 50.

Also, in the current embodiment, punches 48 are provided in the side panels 14B of sections 41 and 42, generally have the same characteristics as punches 28 (described above), and essentially act as stops, contacting the edge of member 45's side panel 14B and thereby maintaining sections 41 and 42 at approximately right angles with respect to member 45 when the frame is in the folded-up configuration. Still further, punches 48 can also provide for easier folding, by functioning as a kind of guide, allowing for additional leverage and/or stabilizing the various segments relative to each other while the component is being folded up. However, in alternate embodiments, punches 48 can be replaced with any other protruding element, such as any of the alternatives described above in reference to punches 28.

Preferably, member 45 is 3-8 inches in length and made of steel and, in the present embodiment, is approximately 3¾ inches long, and also includes openings 51 in its bottom panel 14A. When the bed frame 10 is unfolded into the operational configuration, one of the openings 51 (depending upon whether used in the right side rail or the left side rail) accommodates one of the rivets 50, as shown most clearly in FIG. 5. In certain embodiments, openings 51 and/or the heads of rivets 50 (or bolts or other elements used to secure leg 43 to section 41 or 42) are provided with a resilient material (e.g., in the form of a washer or grommet) so that a compression fit occurs when the bed frame is unfolded into the operational configuration, thereby helping to lock sections 41 and 42 into the desired relationship.

Figure 4:
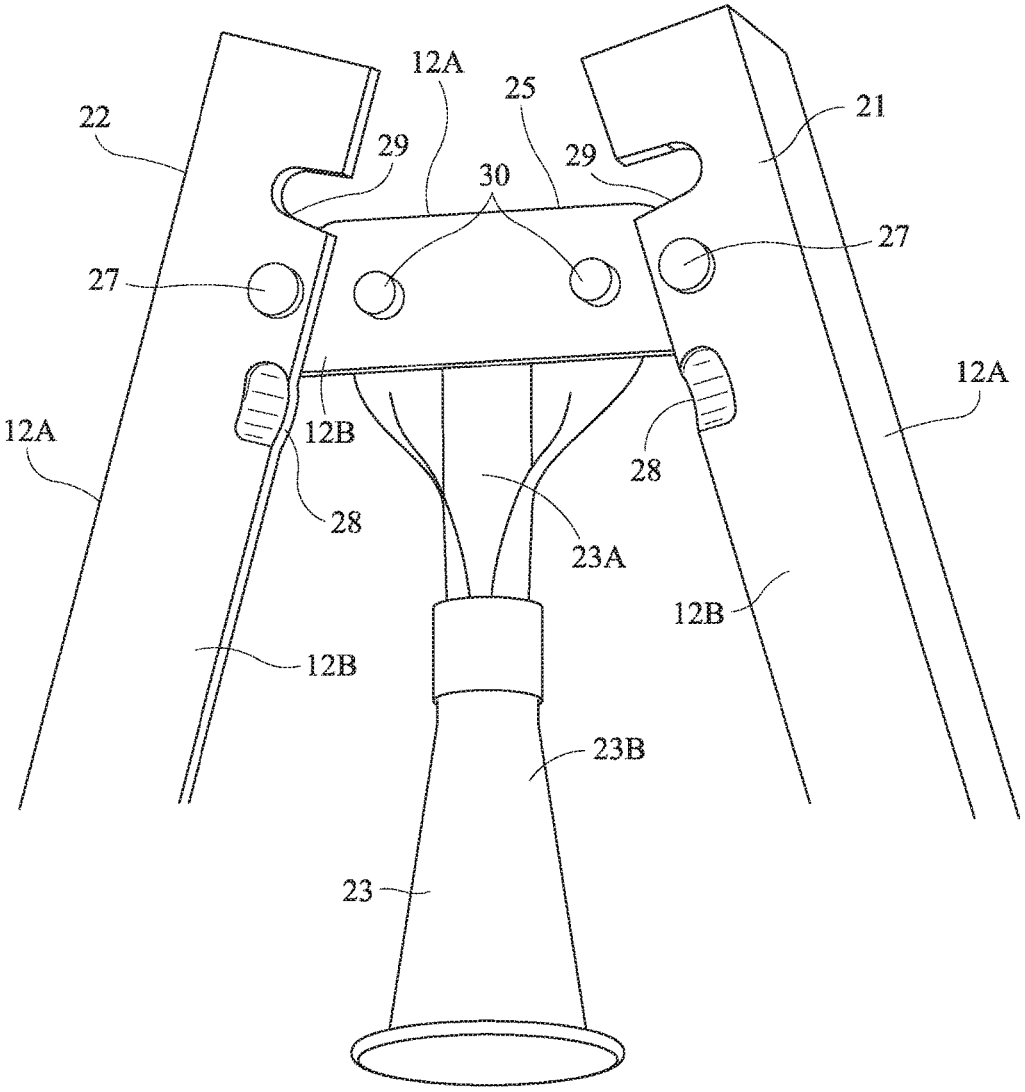
FIG. 4 is a second side perspective view (opposite the first side) of the central portion of the center support, in a partially folded configuration.
Figure 5:
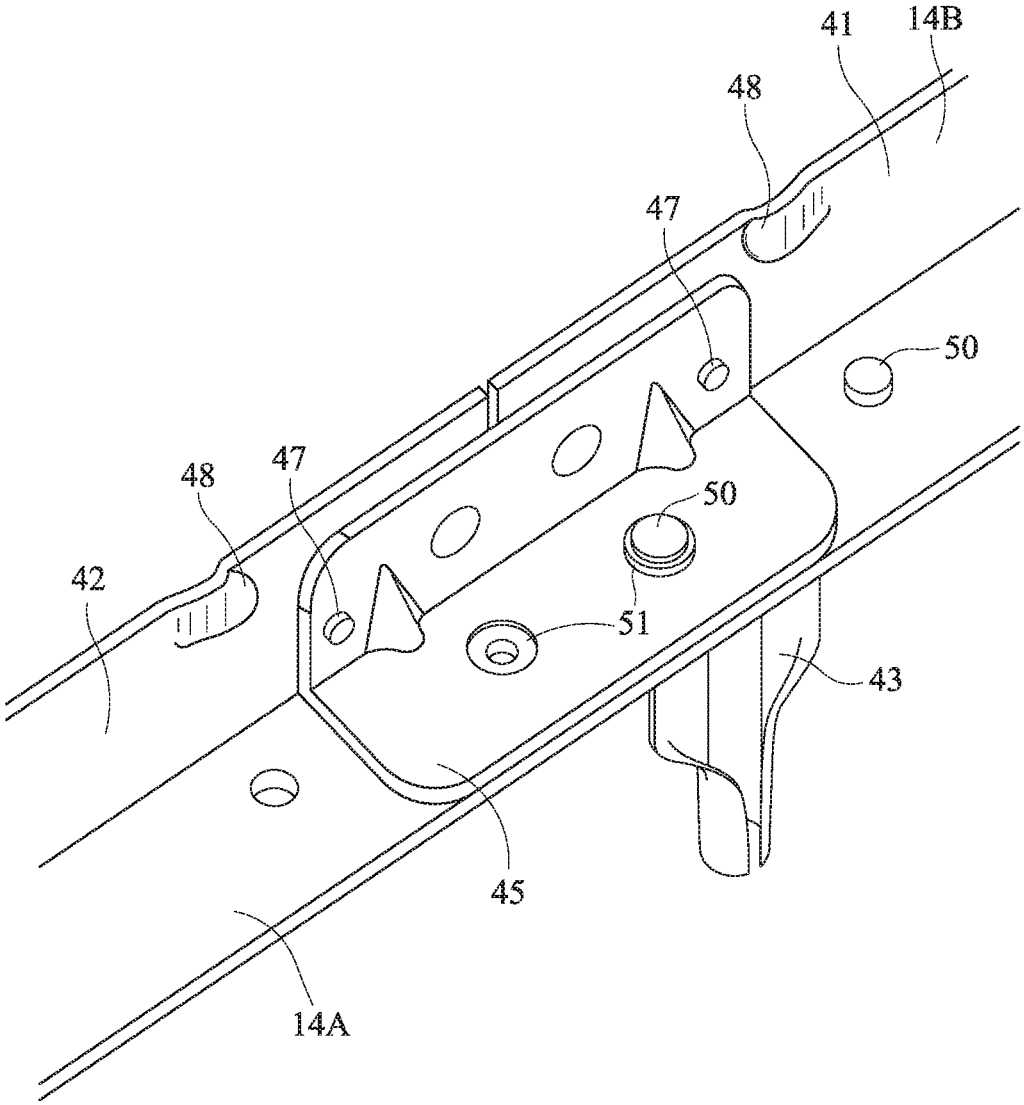
FIG. 5 is a top, inner side perspective view of the central portion of a side rail, in its unfolded (or operational) configuration.
Figure 6:
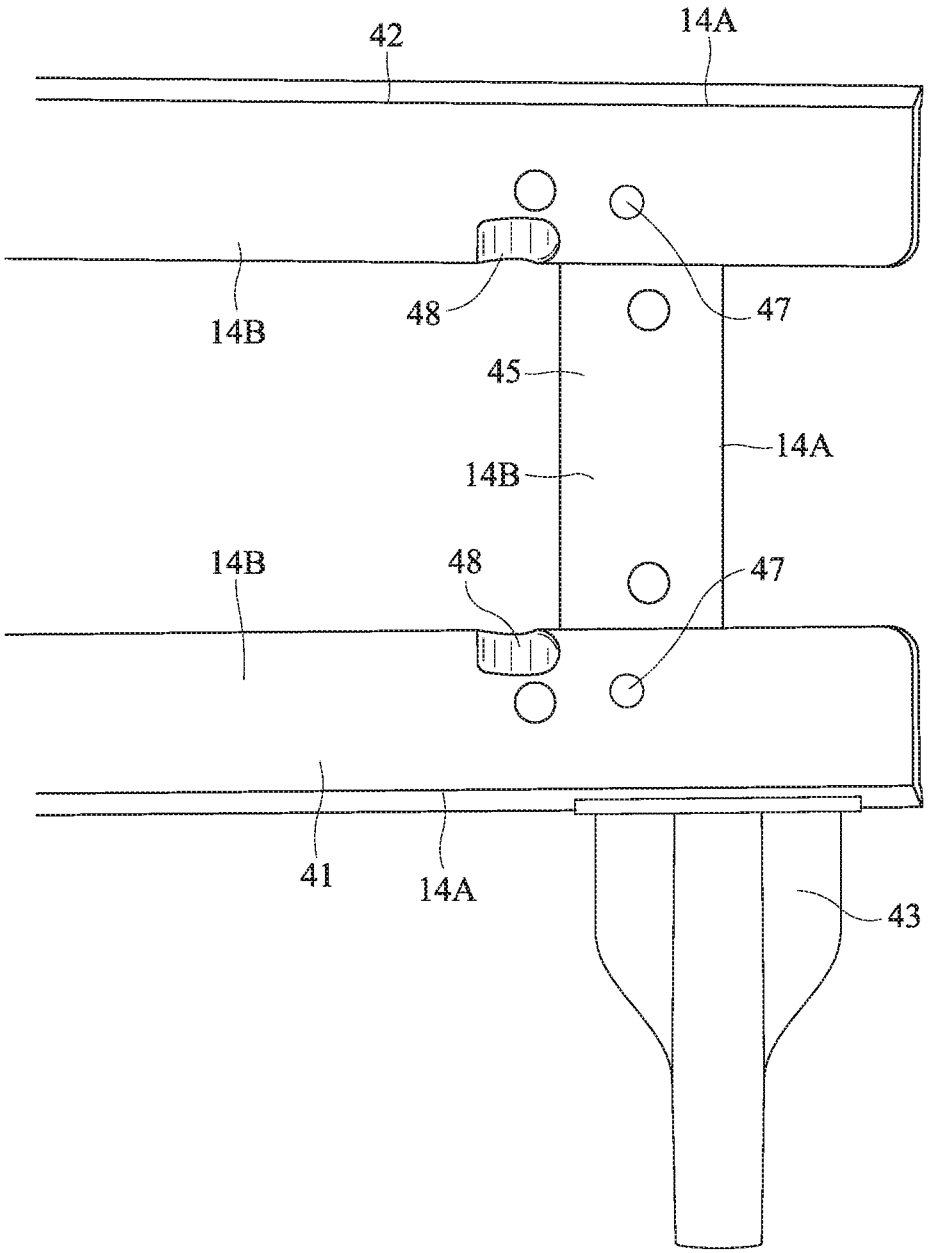
FIG. 6 is an outer side elevational view of the central portion of the side rail in a folded configuration.
Figure 7:
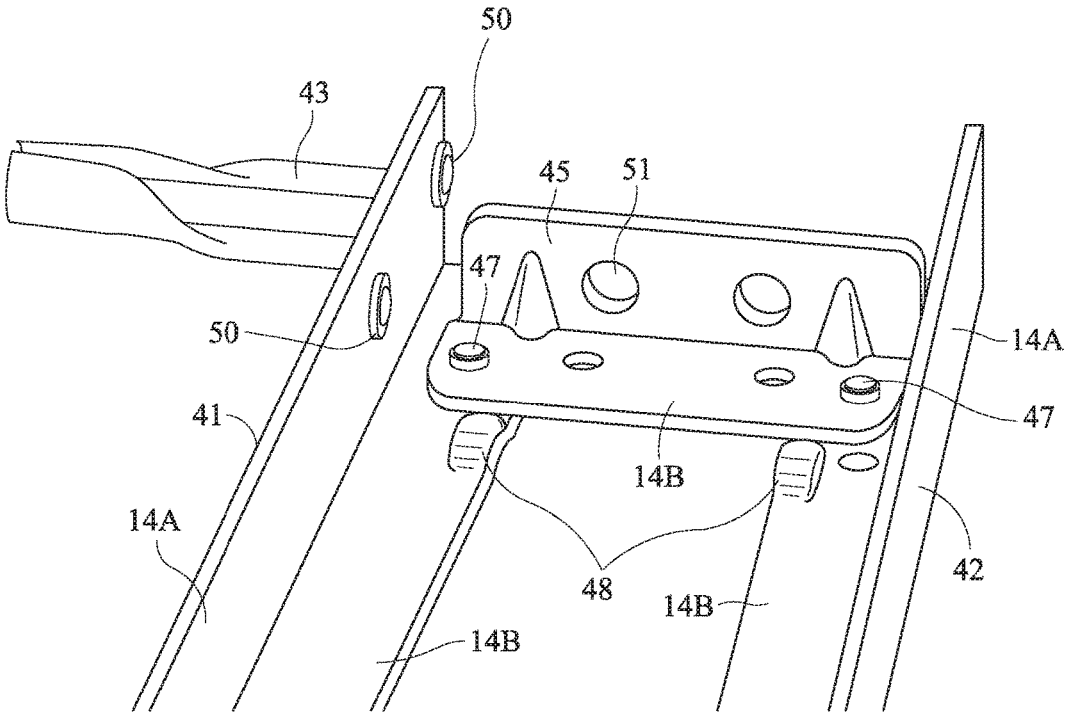
FIG. 7 is a top perspective view of the central portion of the side rail in the folded configuration.
Figure 8:
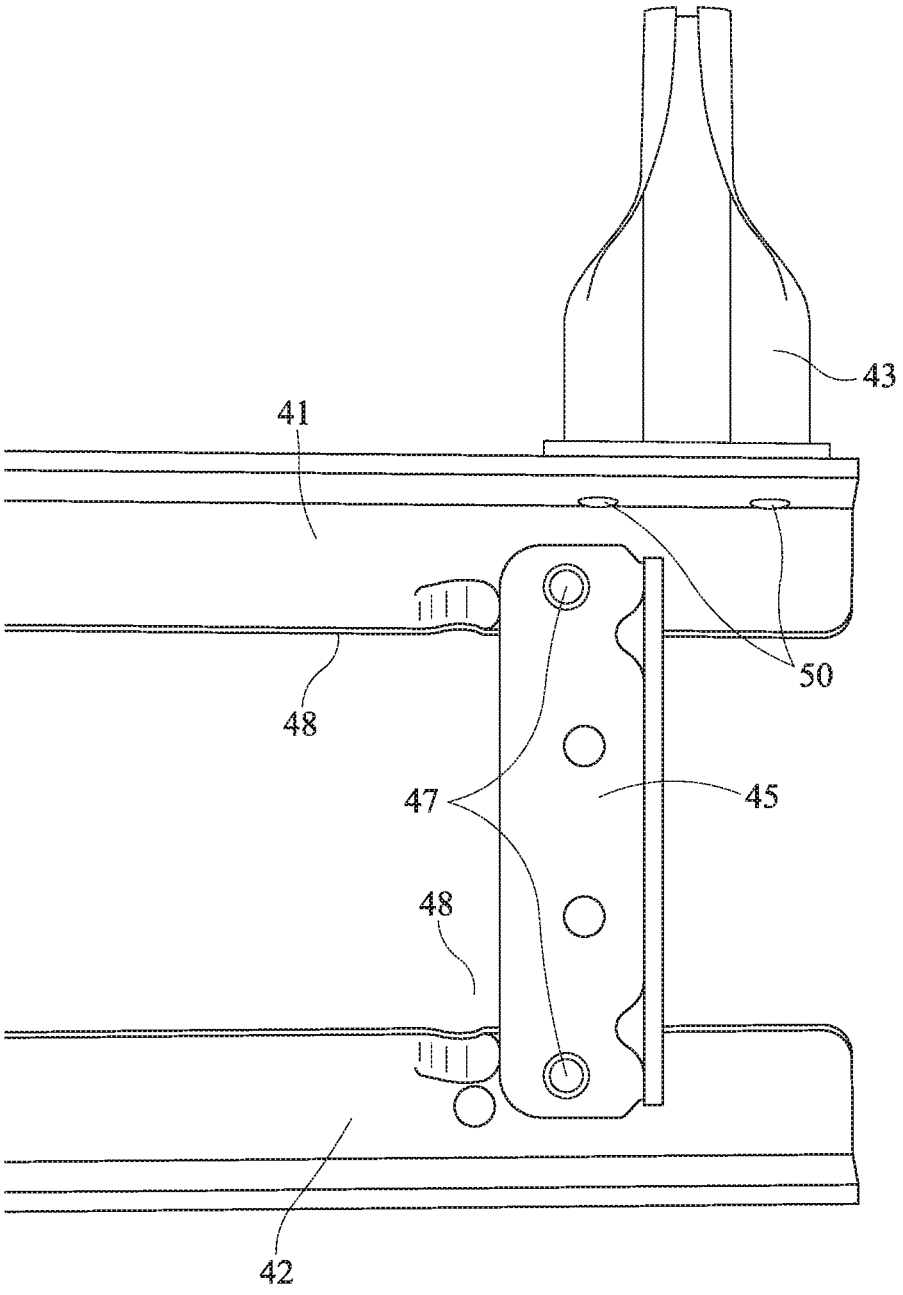
FIG. 8 is an inner side perspective view of the central portion of the side rail in the folded configuration.

The preceding discussion focused on the folding of center support 12 and side rails 14 and 15. In the present embodiment: (1) the center support 12 folds downwardly i.e., so that the two main sections 21 and 22 rotate downwardly (from the top perspective shown in FIGS. 1, 9 and 10); (2) when center support 12 is folded in this manner, leg 23 also extends downwardly, at least approximately parallel to sections 21 and 22 (e.g., as shown in FIGS. 4 and 5); and (3) each of side rails 14 and 15 folds upwardly i.e., so that the two main sections 41 and 42 rotate upwardly (from the top perspective shown in FIGS. 1, 9 and 10), and leg 43 ends up extending off to the side, at least approximately perpendicular to sections 41 and 42 (e.g., as shown in FIGS. 6-8).

Also in the current embodiment, each of members 12, 14 and 15 is part of a larger main component of the bed frame 10. More specifically, center support 12 is part of a center component 65 that also includes a pair of oppositely extending segments 66 and 67 at the head of the bed frame and a pair of oppositely extending segments 68 and 69 at the foot of the bed frame. Each of such segments 66-69 preferably also has an L-shaped cross section (with a top panel and a panel that extends downwardly along the outer edge of the top panel) and is pivotally attached to the corresponding end of center support 12, using a pivot element 72, such as a rivet or a pin. As a result, each of segments 66-69 can be folded inwardly toward, and ultimately parallel with and overlapping, center support 12, and it also can be unfolded to be at least substantially perpendicular to center support 12, with its outer side wall parallel with and abutting the end of center support 12.

Figure 9:
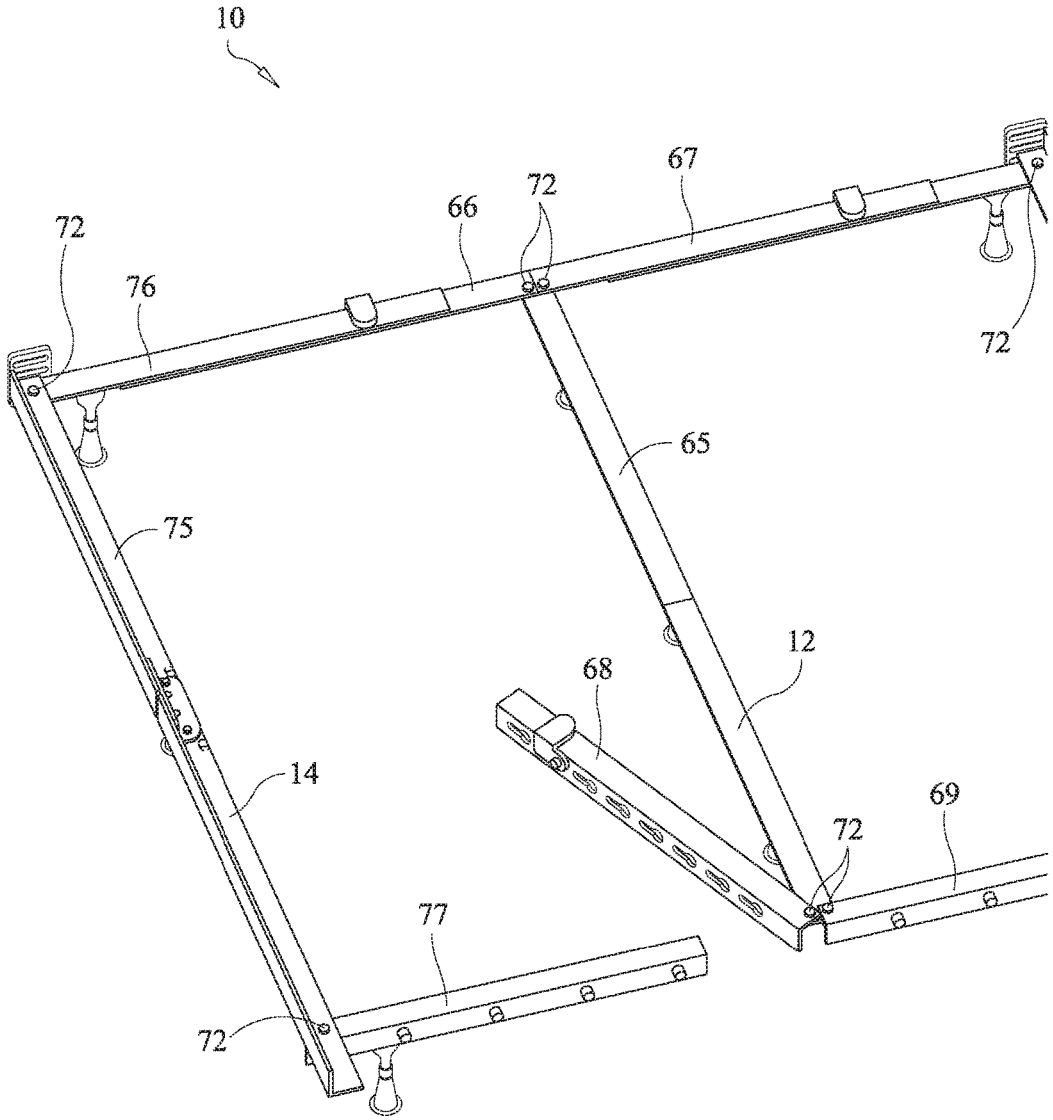
FIG. 9 is a top perspective view of one side rail component and a portion of the center support component, with one of the segments at the foot of the center support component being partially folded, and with the adjacent segments of the two components at the head of the bed frame attached to each other.
Figure 10:
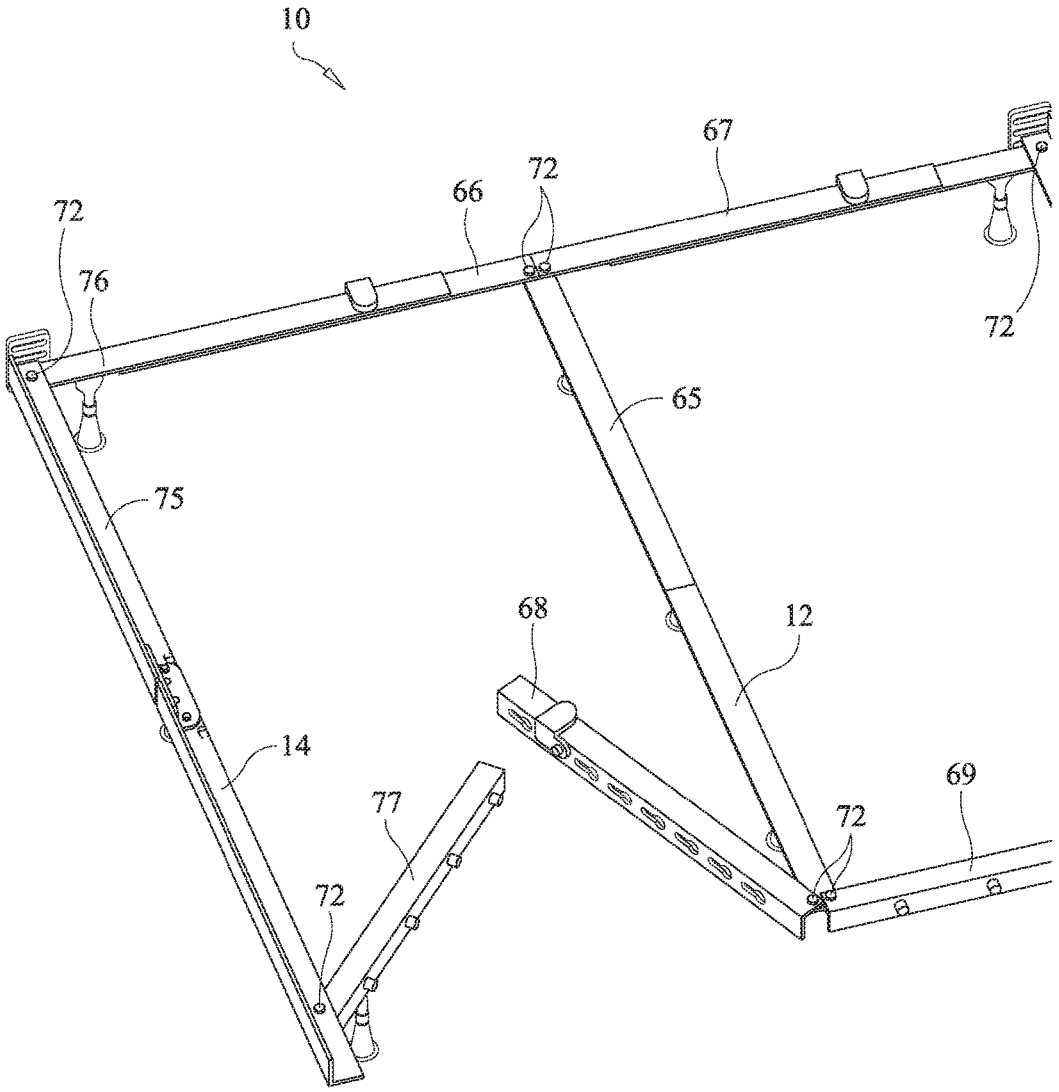
FIG. 10 is a top perspective view of one side rail component and a portion of the center support component, with the adjacent segments at the foot of the two components, which attach to each other when in operational use, being partially folded, and with the adjacent segments of the two components at the head of the bed frame attached to each other.

Similarly, each of side rails 14 and 15 is part of a larger side rail component. FIGS. 9 and 10 show side rail component 75, of which side rail 14 is a part. The side rail component 85 (shown in FIG. 11), of which side rail 15 is a part, essentially is the mirror image of component 75 (e.g., including pivoting segments 86 and 87) and therefore is not separately discussed.

Side rail component 75 includes an inwardly extending segment 76 at the head of the bed frame and an inwardly extending segment 77 at the foot of the bed frame. Each of such segments 76 and 77 also has an L-shaped cross section (with a top panel and a panel that extends downwardly along the outer edge of the top panel) and is pivotally attached to the corresponding end of side rail 14, using a pivot element 72. As result, each of segments 76 and 77 can be folded inwardly toward, and ultimately parallel with and underneath, side rail 14, and it also can be unfolded to be at least substantially perpendicular to side rail 14, with its outer side wall parallel with and abutting the end of side rail 14.

In the current embodiment, each pair of adjacent segments detachably attaches to each other. Thus, segment 66 attaches to segment 76 and segment 68 attaches to segment 77. Similarly, segment 67 attaches to the adjacent segment 86 of component 85 and segment 69 attaches to the corresponding adjacent segment 87 of component 85. A variety of different attachment mechanisms can be used for this purpose, such as screws, nuts, latches and/or clips. However, in the preferred embodiments, the attachment mechanism described in commonly assigned U.S. Pat. No. 5,161,268 (which is incorporated by reference herein as though set forth herein in full) is used, in order to provide the bed frame 10 with an adjustable width, thereby enabling it to accommodate different mattress/box-spring sizes. In the present embodiment, in order to best implement such an attachment mechanism, the segments for components 75 and 85 are configured in such a way that they are not exactly mirror images of each other, i.e., so that both attachments at the head of the bed frame are made in the same direction and both attachments at the foot of the bed frame are made the same direction.

Figure 11:
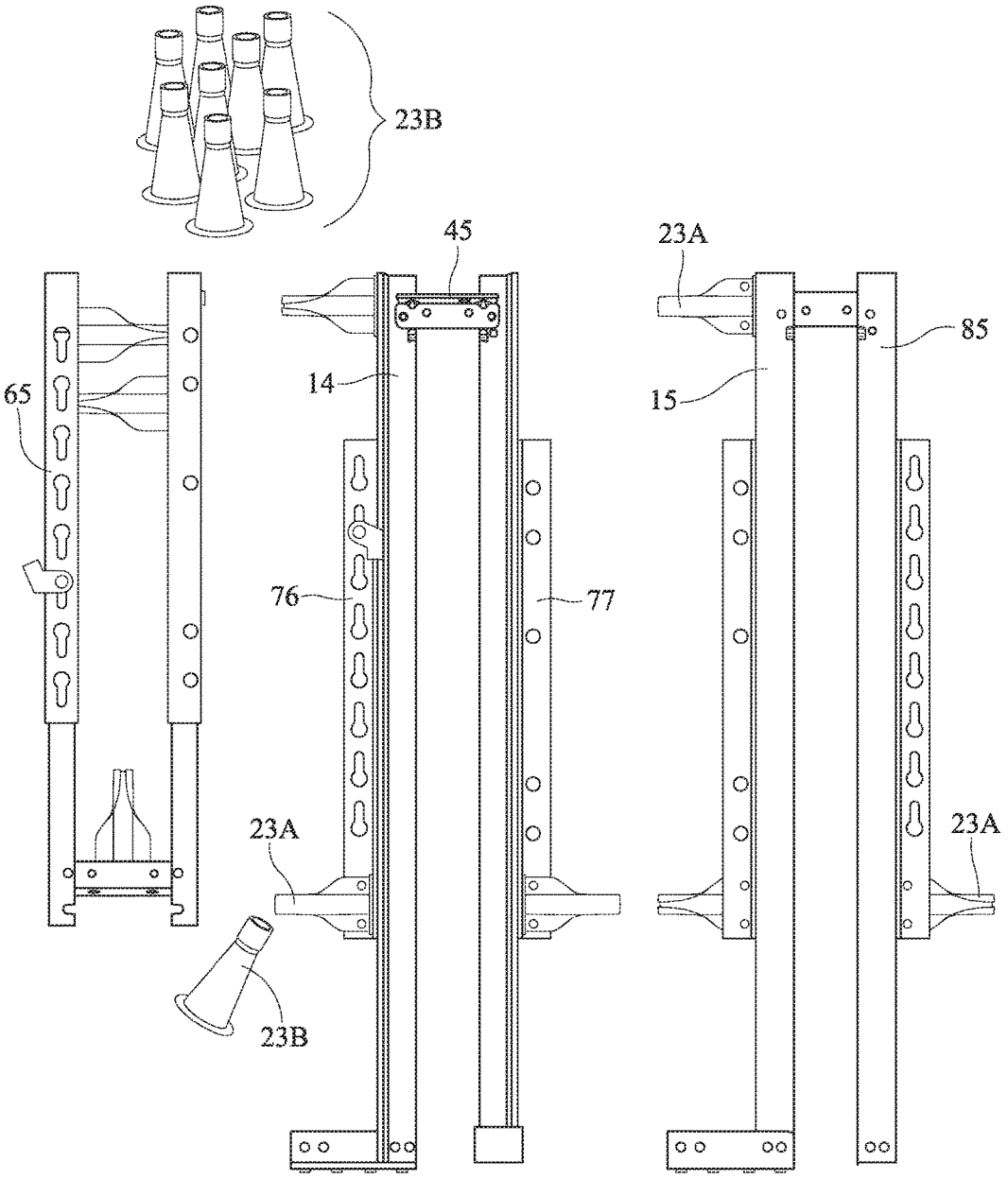
FIG. 11 is a top plan view showing the center support component and the side rail components in their completely folded configuration with their leg glides removed.

As will be readily appreciated, a bed frame according to the present invention can be quickly and easily assembled into its operational configuration and then just as quickly and easily taken apart and folded up for storage and/or transportation. From the operational configuration shown in FIG. 1, one simply removes the glides 23B from all of the legs (23 and 43), detaches the adjacent segments (e.g., adjacent segments 66 and 76, adjacent segments 68 and 77, and the corresponding adjacent segments on the other side of the bed frame 10), folds those segments inwardly toward their corresponding main bed frame components (i.e., components 65, 75 and 85, respectively), and then folds center support 12 downwardly and each of side rails 14 and 15 upwardly. The result is a set of compact components, as shown in FIG. 11. In addition, these components can be further compacted by stacking components 65, 75 and 85 on top of each other, so that the entire bed frame can fit into a fairly small box.

For this purpose, the present inventor has discovered that using central members 25 and 45 with a maximum length of around 4-4½ inches and, more preferably, a maximum length of 3¾ inches, can allow all of the components to fit in a box that is small enough to fit to the cross on a standard-sized palette. More specifically, a bed frame 10 of the present invention, when in its operational configuration, has a length of 70½ inches, a depth of 9 inches, and a width that is adjustable from 38¾ to 72¾ inches. Nevertheless, when disassembled and folded as described above, the entire bed frame 10 can fit into a box of dimensions 36 inches by 15 inches by 4 inches, which also can fit into the trunk of a small car. When desired, the components can be removed from the box and placed into their operational configuration by simply reversing the steps mentioned above. In addition, when using central members 25 and 45 having a maximum length of 3¾ inches, the entire bed frame 10 can fit into a box that is small enough to fit three across on a standard-sized forklift pallet. However, in alternate embodiments central members 25 and 45 have a maximum length, e.g., of 12 inches or even 24 inches.

As noted above, in the present embodiment each of the center support 12, left side rail 14 and right side rail 15 includes two main sections that are pivotally attached to each other through the use of a central member. The use of such a central member allows the main sections to be folded at least substantially parallel to each other and also, in some embodiments, somewhat decreases the overall length of the overall component (at the cost of a somewhat increased width). However, in alternate embodiments the two main sections are directly pivotally attached to each other.

In any event, the two main sections of each such component preferably are at least approximately end-to-end when in the operational configuration and then can be folded so that they are at least approximately parallel to each other for storage, shipping, etc. Any folding that stops short of the point where the two main sections are parallel will increase the width of the component, as folded, and therefore is less optimal. Any folding beyond the point at which the two main sections are parallel does not reduce the overall width and, therefore, generally speaking, does not provide significant benefit.

The present embodiment uses components having an L-shaped cross section, which provides strength while reducing manufacturing costs. However, in alternate embodiments, U-shaped cross-sections (e.g., using three elongated panels with the and panels at least approximately perpendicular to the middle panel), cross-sections of other shapes, or any combination instead may be used.

For instance, in certain alternate embodiments, the shorter center member for any or all of the center support 12, left side rail 14 and right side rail 15 could be implemented as a flat piece. Although such a configuration typically with that provide the same degree of structural strength, such a center member generally could be placed anywhere on the inside or outside of the corresponding main sections, allowing the corresponding component to be folded in any desired manner.

In the foregoing embodiment, the extending segments of the left side component 75 (i.e., segments 76 and 77) detachably couple to the corresponding segments of the right side component 85 (i.e., segments 86 and 87) through the extending segments of the center component 65 (i.e., segments 66 and 67 for segment 76 and 68 and 69 for segment 77) in order to provide a complete lateral support at the head of the bed frame 10 and another complete lateral support at the foot of the bed frame 10, respectively, when the bed frame is fully assembled and in its operational state. However, in alternate embodiments (e.g., where cost reduction is desired), the center component 65 is omitted and/or the adjacent segments of the left side component 75 and the right side component 85 either directly detachably attach to each other or are detachably coupled to each other through any other type of component. As used herein, the term "coupled", or any other form of the word, is intended to mean either directly connected or connected through one or more other elements or components (e.g., for reinforcement or for any other purpose).

In the preferred embodiments of the invention, a single component can serve as the center member (25 and 45, respectively) for any of the center support 12 (if used), the left side rail 14 and/or the right side rail 15. That is, a single component preferably is manufactured so as to have all of the features (e.g., all of the openings) described above for center members 25 and 45, even if all of such features are not actually utilized in each usage scenario (i.e., when installed as part of the center support 12, the left side rail 14 or the right side rail 15) or, stated differently, all three center members 25 and 45 are identical to each other. For example, as indicated in FIG. 5, in the present embodiment one panel of such a common component includes four openings (two in central portion and one at each end), while the other (perpendicular or approximately perpendicular) panel includes two openings (in the central portion). As a result of using such a common component, tooling and manufacturing costs typically can be significantly reduced.

Additional Considerations.

In the event of any conflict or inconsistency between the disclosure explicitly set forth herein or in the attached drawings, on the one hand, and any materials incorporated by reference herein, on the other, the present disclosure shall take precedence. In the event of any conflict or inconsistency between the disclosures of any applications or patents incorporated by reference herein, the more recently filed disclosure shall take precedence.

Words such as "optimal", "optimize", "minimize", "maximize", "best" and similar words are used throughout the above discussion. However, it should be understood that, except to the extent clearly indicated to the contrary, such words are not used in their absolute sense, but rather are intended to be viewed in light of other constraints, such as user-specified constraints and objectives, as well as cost and processing constraints.

In the above discussion, certain methods are explained by breaking them down into steps listed in a particular order. However, it should be noted that in each such case, except to the extent clearly indicated to the contrary or mandated by practical considerations (such as where the results from one step are necessary to perform another), the indicated order is not critical but, instead, that the described steps can be reordered and/or two or more of such steps can be performed concurrently.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

In the discussions above, the words "include", "includes", "including", and all other forms of the word should not be understood as limiting, but rather any specific items following such words should be understood as being merely exemplary.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention are to be considered as within the scope thereof as limited solely by the claims appended hereto.

What is claimed is:

1. A bed frame, comprising:

a left side component that includes an elongated left side rail and an extending segment at each end, each said extending segment of the left side component pivotally attached to the elongated left side rail and capable of being pivoted from substantially parallel said left side rail to substantially perpendicular said left side rail; and a right side component that includes an elongated right side rail and an extending segment at each end, each said extending segment of the right side component pivotally attached to the elongated right side rail and capable of being pivoted from substantially parallel said right side rail to substantially perpendicular said right side rail, wherein each of the elongated left side rail and the elongated right side rail comprises two elongated panels that are substantially perpendicular to each other, wherein each of the elongated left side rail and the elongated right side rail includes two main sections that are pivotally attached to a shorter center member, wherein each of the two main sections for each of the elongated left side rail and the elongated right side rail has an L-shaped cross-section, and wherein at each end, the extending segments of the left side component and the right side component detachably couple to each other, forming lateral components of a bed frame assembly;

the bed frame further comprising a protrusion on a first component that contacts an edge of a second component and thereby functions as a stop, wherein the stop has been formed by at least one of punching or denting a panel of the first component, whereby the protrusion bulges inwardly with a smoothly sloping side so that said edge gradually engages with said protrusion.

2. The bed frame according to claim 1, wherein a first one of the two elongated panels of each of the elongated left side rail and the elongated right side rail forms a bottom surface of the bed frame assembly, and a second one of the two elongated panels of each of the elongated left side rail and the elongated right side rail forms a side surface of the bed frame assembly that extends upwardly from the first one of the two elongated panels.

3. The bed frame according to claim 1, wherein each of the two main sections and the shorter center member of each of the elongated left side rail and the elongated right side rail are pivotally attached to each other at just a single pivot point.

4. The bed frame according to claim 3, wherein each said single pivot point is implemented using one of a rivet or a pin.

5. The bed frame according to claim 1, wherein the shorter center member for each of the elongated left side rail and the elongated right side rail is 3-8 inches in length.

6. The bed frame according to claim 1, wherein the shorter center member for each of the elongated left side rail and the elongated right side rail has a maximum length of 4½ inches.

7. The bed frame according to claim 1, wherein the shorter center member for each of the elongated left side rail and the elongated right side rail has a maximum length of 3¾ inches.

8. The bed frame according to claim 1, wherein from an operational configuration, each of the elongated left side rail and the elongated right side rail folds upwardly.

9. The bed frame according to claim 1, wherein the extending segments of the left side component and the right side component have L-shaped cross sections.

10. The bed frame according to claim 1, wherein the shorter center member for each of the elongated left side rail and the elongated right side rail is a flat piece.

11. The bed frame according to claim 10, wherein each of the two main sections and the shorter center member of each of the elongated left side rail and the elongated right side rail are pivotally attached to each other at just a single pivot point.

12. The bed frame according to claim 10, wherein the shorter center member for each of the elongated left side rail and the elongated right side rail is disposed outside of the two main sections of each of the elongated left side rail and the elongated right side rail.

13. The bed frame according to claim 1, wherein each of the extending segments of the left side component can be folded inwardly toward, and ultimately parallel with, the elongated left side rail, and wherein each of the extending segments of the right side component can be folded inwardly toward, and ultimately parallel with, the elongated right side rail.

* * * * *